US006577215B2

(12) United States Patent
Nomura et al.

(10) Patent No.: US 6,577,215 B2
(45) Date of Patent: Jun. 10, 2003

(54) INSTANTANEOUS-TRIPPING CIRCUIT BREAKER

(75) Inventors: Koji Nomura, Saitama (JP); Katsunori Kuboyama, Saitama (JP); Koji Asakawa, Saitama (JP); Isamu Nagahiro, Saitama (JP); Takeshi Emura, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/988,032

(22) Filed: Nov. 16, 2001

(65) Prior Publication Data

US 2002/0063615 A1 May 30, 2002

(30) Foreign Application Priority Data

Nov. 29, 2000 (JP) ..... 2000-363276

(51) Int. Cl.[7] ..... H01K 67/02
(52) U.S. Cl. ..... 335/132; 335/202
(58) Field of Search ..... 335/132, 202, 335/23, 35, 42, 16, 147, 195, 167–176; 200/293–308

(56) References Cited

U.S. PATENT DOCUMENTS 5,231,365 A * 7/1993 Kato ..... 335/132

FOREIGN PATENT DOCUMENTS

JP 2001-345038 * 12/2001

* cited by examiner

*Primary Examiner*—Lincoln Donovan
(74) *Attorney, Agent, or Firm*—Kanesaka & Takeuchi

(57) ABSTRACT

In an instantaneous-tripping circuit breaker, a heater-mounted main bimetal, a shifter of a differential shifter mechanism, and an adjustment dial of a thermal overload/open-phase tripping device are removed from a standard circuit breaker equipped with a breaking section, an opening and closing mechanism section, a thermal overload/open-phase tripping device, and an electromagnetic instantaneous tripping device in a case. Instead, a trip coil of the instantaneous tripping device is connected to a main circuit via a connection conductor of a low resistance, a test-tripping part is mounted in place of the shifter of the differential shifter mechanism, and the adjustment dial is replaced with a dummy dial. Accordingly, the standard circuit breaker is changed to an instantaneous-breaking circuit breaker.

3 Claims, 4 Drawing Sheets

INSTANTANEOUS-TRIPPING CIRCUIT BREAKER

BACKGROUND OF THE INVENTION AND RELATED ART STATEMENT

The present invention relates to a circuit breaker, such as an autobreaker, applied to the protection of an electric motor.

Manufacturers of such circuit breakers, which are main components of low-voltage distribution devices, define the products with the construction described below as a standard and produce variations thereof to meet users' various needs.

The construction of the standard circuit breaker is shown in FIGS. 5, 6(*a*), and 6(*b*), using an autobreaker by way of example. In FIG. 5, reference numeral 1 denotes a circuit breaker case (resin mold case), 2 is a power-supply-side main circuit terminal, 3 is a load-side main circuit terminal, 4 is a handle for opening-and-closing operations, 5 is an adjustment dial for adjusting a rated current, with the adjustment dial facing a cover 1*a* of the case 1, 6 is a test trip slot into which a screwdriver or the like is inserted from the outside for a trip test, and 7 is a name plate. The case 1 has a main circuit breaking section 8, which is formed of a movable contact shoe 8*a*, a fixed contact shoe 8*b*, and an arc-extinguishing chamber 8*c*; a toggle-link-type opening and closing mechanism section 9 for driving the movable contact shoe 8*a* of the breaking section 8 between an open position and a closed position; a thermal overload/open-phase tripping device 10 corresponding to each phase; and an electromagnetic instantaneous tripping device 11. These components are arranged as illustrated in FIGS. 6(*a*) and 6(*b*).

In this case, the thermal overload/open-phase tripping device 10 and the electromagnetic instantaneous tripping device 11 are integrally assembled together for each phase, to constitute a trip unit. The thermal overload/open-phase tripping device 10 is formed of a combination of a heater-mounted main bimetal 12 connected to each phase of the main circuit, a differential shifter mechanism 13 linked with a main bimetal operating end (upper end) for each phase so as to interconnect with the bimetal, a temperature-compensating bimetal 14 for linking an output end of the differential shifter mechanism 13 with a latch receiver incorporated into the opening and closing mechanism section 9, with the temperature-compensating bimetal 14 also being used as a tripping lever, and the adjustment dial 5 described previously.

Further, the differential shifter mechanism 13 is formed of a combination of a sliding push shifter 15 and a sliding pull shifter 16, which are positioned along the main bimetals 12 for the respective phases on the respective sides thereof, and are guided and supported in a groove in an interphase partition wall 1*b* of the case 1, with an output lever 17 extending over the push shifter 15 and the pull shifter 16 and being pivotally coupled with pins. The push shifter 15 and pull shifter 16 have L-shaped arms 15*a* and 16*a*, respectively, which project toward the main bimetal 12 for each phase, so that in an assembled position, the tips of the arms are located opposite to the respective surfaces of the main bimetal 12 so as to sandwich the main bimetal therebetween. Furthermore, the adjustment dial 5 described above has a groove 5*a* formed in a top surface thereof into which a screwdriver or the like is inserted for operation. A rated current value is printed around the periphery of a dial hole opened in the case cover 1*a* so as to correspond to an arrow printed on the top surface of the dial 5.

The operation of the thermal overload/open-phase tripping device 10 is well known. When an overload current continuously flows through the main circuit, the main bimetal 12 is bent correspondingly in a predetermined direction under heat by the heater, and the push shifter 15 and pull shifter 16 of the differential shifter mechanism 13 are displaced in the direction indicated by an arrow in FIG. 6(*a*) so as to follow the bending of the bimetal. The output lever 17 then pushes the tip of the temperature compensating bimetal 14. This causes the temperature compensating bimetal 14 to rotate clockwise to push the latch receiver into its released position, and in synchronism with this movement, the opening and closing mechanism section 9 performs a trip operation to open the movable contact shoe 8*a* of the breaking section 8, interrupting the current flowing through the main circuit. If an open phase occurs, the push shifter 15 and pull shifter 16 of the differential shifter mechanism 13 operate in a differential manner to cause the output lever 17 to rotate counterclockwise around the pin for coupling with the pull shifter in order to push the temperature compensating bimetal 14, thereby causing the circuit breaker to perform a trip operation as described above.

On the other hand, the electromagnetic instantaneous tripping device 11 is formed of a trip coil 11*a*, which is commonly referred to as an "instant coil", a yoke 11*b*, a plunger 11*c*, and a tripping lever 11*d* that follows the operation of the plunger 11*c*. The trip coil 11*a* and the heater-mounted main bimetal 12 are connected together in series, and are interposed between and connected to the load-side main circuit terminal 3 and the fixed contact shoe 8*a* of the breaking section 8. When an overcurrent, such as short circuit current, flows through the main circuit, the plunger 11*c* performs a suctioning operation to cause the tripping lever lid to depress a tripping plate incorporated in the opening and closing mechanism section 9, thereby driving the latch receiver described above into its released position in order to cause the circuit breaker to instantaneously perform a trip operation.

If the opening and closing mechanism section 9 undergoes a trip test in a non-conductive state, a screwdriver or the like is inserted into the test trip slot 6, shown in FIG. 5, from the outside in order to move the output lever 17 (which has a projection to be caught by a tip of the screwdriver) of the differential shifter mechanism 13 (see FIGS. 6(*a*) and 6(*b*)). Then, as in the tripping operation for the overload current, the latch receiver of the opening and closing mechanism section 9 moves to its released position via the temperature compensating bimetal 14 to perform a trip operation.

When a standard circuit breaker provided with the thermal overload/open-phase tripping device 10 and the electromagnetic instantaneous tripping device 11 as standard equipments is applied to a distribution circuit using as a load an electric motor requiring an extended period for start-up, the start current and time for the electric motor can not be coordinated with the overload protection characteristics of the circuit breaker. Consequently, while the electric motor is being started up, the thermal overload/open-phase tripping device 10 may operate to cause the circuit breaker to perform a trip operation.

Thus, a feeding circuit using as a load an electric motor requiring a particularly long time for start-up may employ a circuit breaker comprising the standard circuit breaker described above, which does not perform the overload/open-phase tripping function in order to prevent the circuit breaker from inadvertently performing a trip operation while the electric motor is being started up. Instead, a thermal relay is connected to the load side of the circuit breaker to protect the electric motor from overload.

Further, in a variation of a circuit breaker that is adapted for the above application conventionally, the differential shifter mechanism 13, the temperature compensating bimetal 14, and the adjustment dial 5 are removed from the standard circuit breaker shown in FIGS. 6(*a*) and 6(*b*) in order to disable the overload/open-phase tripping function, and the case cover 1*a*, shown in FIG. 5, is modified so that the dial hole and test trip slot therein are blocked.

However, the conventional instantaneous-tripping circuit breaker, which is provided as the variation of the circuit breaker by removing accessory parts of the overload/open-phase tripping device from the standard circuit breaker and replacing the case cover thereof with a modified one, entails economic and functional problems, as stated below:

(1) As the case cover differs from that of the standard circuit breaker, a new mold must be provided to produce the case cover, thus increasing a cost.

(2) As the differential shifter mechanism 13 of the overload/open-phase tripping device 10 is not incorporated, the test trip function by using the differential shifter mechanism is eliminated.

(3) Furthermore, as the heater-mounted main bimetal 12 of the overload/open-phase tripping device 10 is left connected to the main circuit in series with the trip coil of the electromagnetic instantaneous tripping device, a circuit breaker with a high rated current can not withstand the required amount of overload current for the instantaneous tripping method. That is, the heater of the main bimetal 12 is selected to have a resistance value that allows an overload/open phase in the main circuit to be detected in order to generate a sufficient amount of heat to bend the bimetal. Thus, if a high overload current continuously flows, as in the application of the conventional circuit breaker to the load circuit of a large electric motor requiring an extended period for startup, the amount of heat generated by the heater increases, possibly resulting in melting and breaking the heater.

The present invention has been made in view of these points, and it is an object thereof to provide an instantaneous-tripping circuit breaker that disables the overload/open-phase tripping function while maintaining the test trip function without significant increase in cost, simply by removing a part of the thermal overload/open-phase tripping device from the standard circuit breaker provided with the thermal overload/open-phase tripping device and the electromagnetic instantaneous tripping device as standard equipments and replacing it with another part, with the instantaneous-tripping circuit breaker being able to be safely applied to an electric motor requiring an extended period for start-up.

SUMMARY OF THE INVENTION

To attain this object, the present invention provides an instantaneous-tripping circuit breaker. In this case, a standard circuit breaker comprises a breaking section, an opening and closing mechanism section, a thermal overload/open-phase tripping device, and an electromagnetic instantaneous tripping device, all installed in a breaker case. The thermal overload/open-phase tripping device includes an assembly of a heater-mounted main bimetal connected to each phase of a main circuit, a differential shifter mechanism moved together with the main bimetal, a temperature compensating bimetal for linking an output end of the differential shifter mechanism with a latch receiver of the opening and closing mechanism section, with the temperature compensating bimetal also being used as a tripping lever. An adjustment dial is also provided for making adjustments of the rated current. In the first aspect of the invention, the heater-mounted main bimetal is omitted from a trip unit of the standard circuit breaker, and a trip coil of the electromagnetic instantaneous tripping device is connected to the main circuit via a connection conductor having a lower resistance than the heater of the main bimetal.

As described above, the heater-mounted main bimetal is removed from the thermal overload/open-phase tripping device installed in the standard circuit breaker, and the connection conductor of a lower resistance is used in place of the heater to connect the trip coil of the electromagnetic instantaneous tripping device to the main circuit. Consequently, the required amount of the overload current for the instantaneous-tripping circuit breaker can be obtained to make the circuit breaker more reliable.

In the construction of the first aspect, in place of the differential shifter mechanism installed in the standard circuit breaker, a test-tripping part is assembled in the breaker case, and an output lever supported on the test-tripping part is located opposite to the temperature compensating bimetal, and is operated from the outside of the case to conduct a trip test on the breaker (second aspect of the invention). With this construction, by simply replacing the differential shifter mechanism of the overload/open-phase tripping device with the simple test-tripping part, the temperature compensating bimetal can be used to provide a trip test function similar to that provided by the standard circuit breaker.

Moreover, in the construction of the first aspect, the adjustment dial for the rated current is replaced with a dummy dial having no adjustment function and facing a dial hole in the breaker case (third aspect of the invention). Thus, the case cover of the standard circuit breaker can be applied directly to the breaker case to allow parts to be shared. Further, as no adjustment groove is formed in the top surface of the dummy dial, it can be visually determined that this circuit breaker is based on an instantaneous tripping type without any overload/open-phase tripping function.

DETAILED DESCRIPTION OF PREFERRED EMBODIMENTS

Figure 1A:
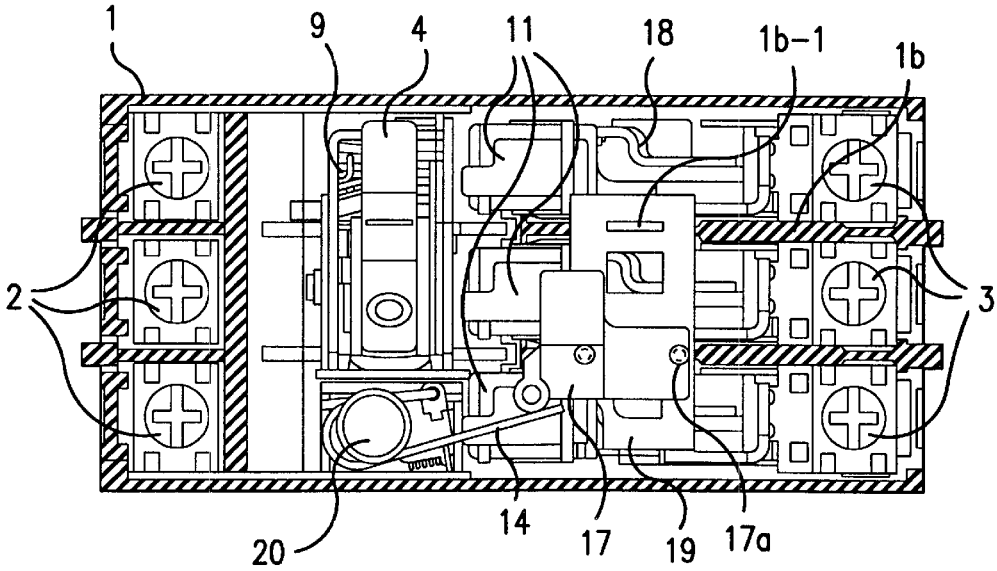
FIGS. 1(*a*) and 1(*b*) are views showing an internal structure of a circuit breaker according to a variation of an embodiment of the present invention, wherein FIG. 1(*a*) is a plan view showing the circuit breaker with its case cover removed, and FIG. 1(*b*) is a side sectional view of FIG. 1(*a*)
Figure 1B:
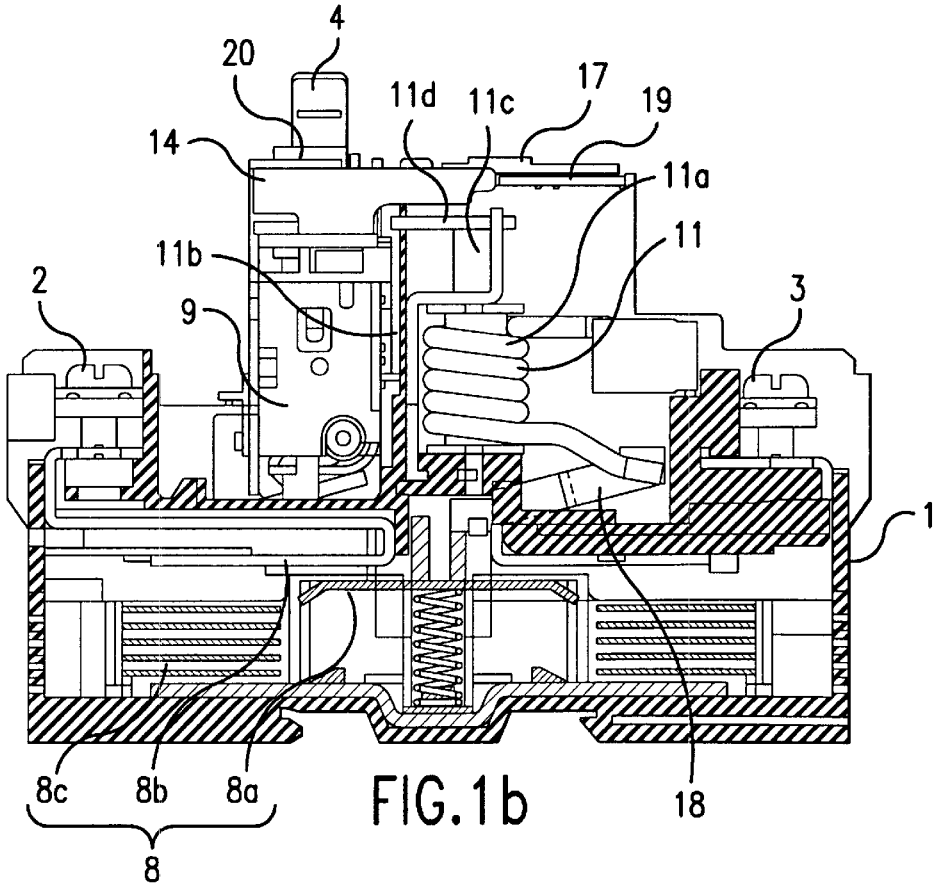
Figure 5:
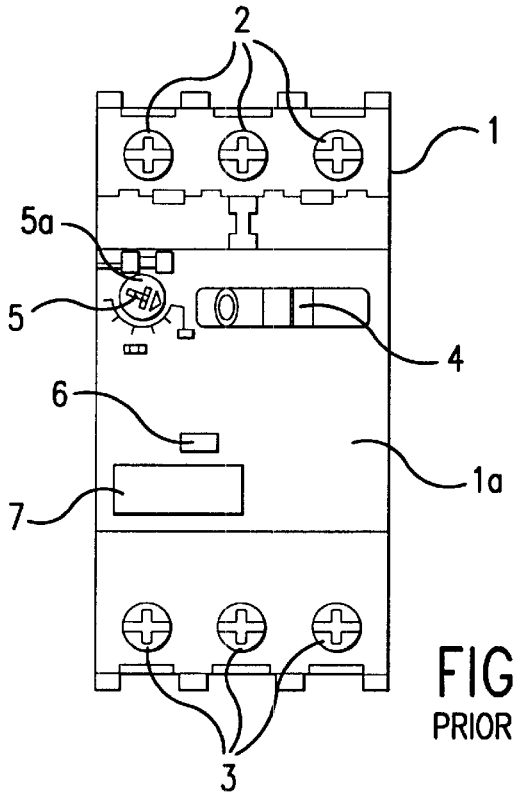
FIG.5 PRIOR ART
FIG. 5 is a plan view showing a standard circuit breaker with a case cover placed thereon.

An embodiment of the present invention will be described below with reference to FIGS. 1(*a*) to 4. The members shown in the figures for this embodiment that correspond to FIGS. 5 to 6(*b*) are denoted by the same reference numerals, and detailed descriptions thereof are omitted. First, in an instantaneous-tripping circuit breaker according to the embodiment of the present invention, which is shown in FIGS. 1(*a*) and 1(*b*), the heater-mounted main bimetal 12, the push shifter 15 and pull shifter 16 of the differential shifter mechanism 13, and the adjustment dial 5 have been removed from the thermal overload/open-phase tripping device 10 installed in the standard circuit breaker shown in FIGS. 6(*a*) and 6(*b*). In place of these parts, the parts described below are installed in this circuit breaker.

In place of the heater-mounted main bimetal, a connection conductor 18 is used for connecting the trip coil 11*a* of the electromagnetic instantaneous tripping device 11 directly to the fixed contact shoe 8*b* and load side terminal 3 of the main circuit. Further, in place of the push and pull shifters of the differential shifter mechanism, a test-tripping part 19 is engaged and installed on the interphase partition wall 1*b* of the case 1 so that the output lever 17 is supported on the test-tripping part. Furthermore, the adjustment dial 5 has been replaced with a dummy dial 20 without any adjustment function.

Figure 2:
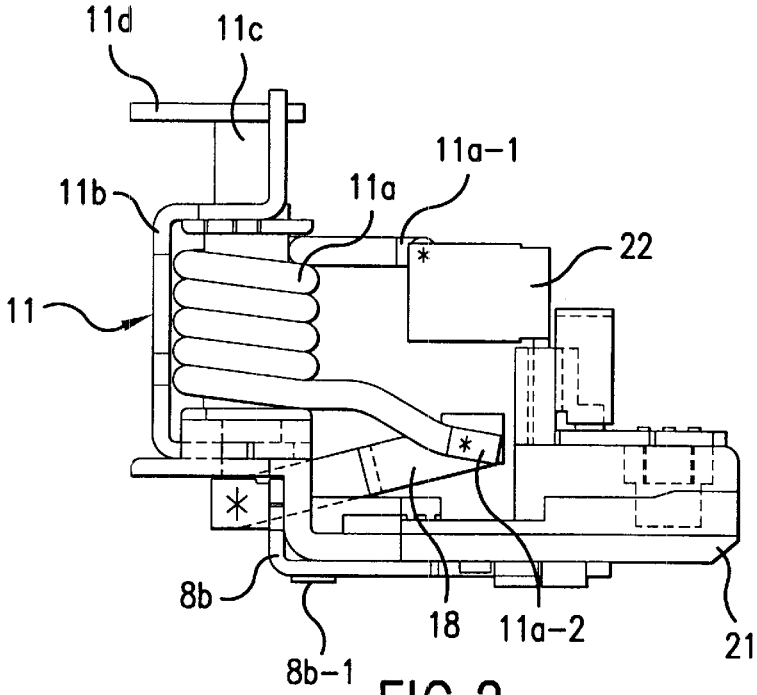
FIG. 2 is a diagram showing an assembled structure of an electromagnetic instantaneous tripping device shown in FIGS. 1(*a*) and 1(*b*)

FIG. 2 shows an assembled structure of the electromagnetic instantaneous tripping device 11. In this figure, reference numeral 21 denotes a trip-unit assembly base on which the electromagnetic instantaneous tripping device 11 and overload/open-phase tripping device described above are mounted. In the condition that the overload/open-phase tripping device is removed as described previously, one terminal 11*a*-1 drawn out from the trip coil 11*a* of the electromagnetic instantaneous tripping device 11 is soldered to a terminal conductor 22 connected to the load side terminal of the main circuit, while the other terminal 11*a*-2 is soldered to the fixed contact shoe 8*b*, which is disposed in the breaking section 8 (see FIG. 1(*b*)), via the connection conductor 18, which is replaced instead of the bimetal heater described above. Then, in this construction, the main circuit current is allowed to flow through the trip coil 11*a*. Further, the connection conductor 18 is composed of a bar made of, such as copper, that has a resistance lower than that of the bimetal heater of the overload/open-phase tripping device so as to withstand the required amount of the overload current and ensure the required breaking performance. The cross section and resistivity of the conductor are selected to meet the conditions, such as the rated current of the circuit breaker. In the figures, reference numeral 8*b*-1 denotes a contact of the fixed contact shoe 8*b*.

Figure 3:
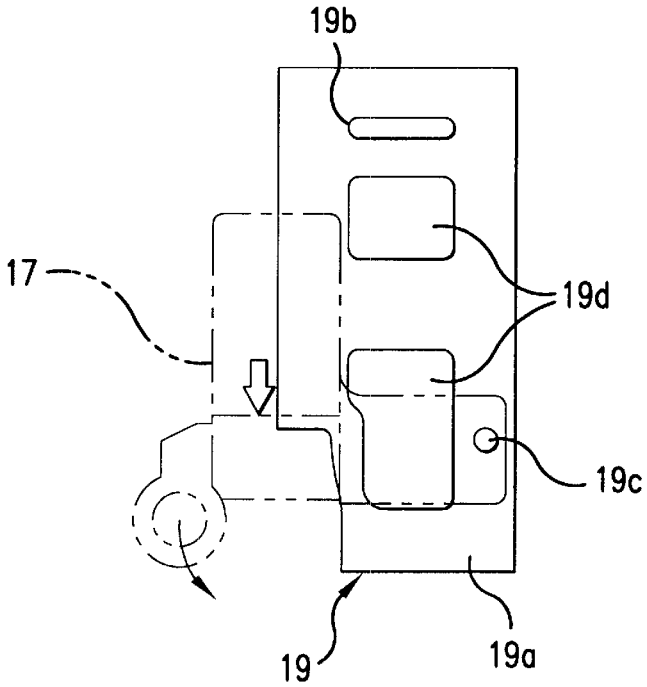
FIG. 3 is a plan view of a test-tripping member shown in FIGS. 1(*a*) and 1(*b*)

On the other hand, the test-tripping part 19, replacing the push and pull shifters of the differential shifter mechanism, comprises a resin guide plate 19*a* having a mounting slot 19*b* formed in a surface thereof and a support hole 19*c* also formed in the surface thereof to pivotally support one end of the output lever 17 of the differential shifter mechanism, as shown in FIG. 3. The projection 1*b*-1, formed on the interphase partition wall 1*b* of the case 1 as illustrated in FIG. 1(*a*), is fitted into the mounting slot 19*b* and engagingly locked in place so that in this mounting position, the output lever 17 is located opposite to the tip of the temperature compensating bimetal 14. With this construction, a trip test can be conducted. Reference numeral 19*d* denotes slots formed to prevent interference with the main bimetal if the push and pull shifters of the differential shifter mechanism are replaced with the test-tripping part 19 while the heater-mounted main bimetal 12 remains (see FIGS. 6(*a*) and 6(*b*)).

Figure 4:
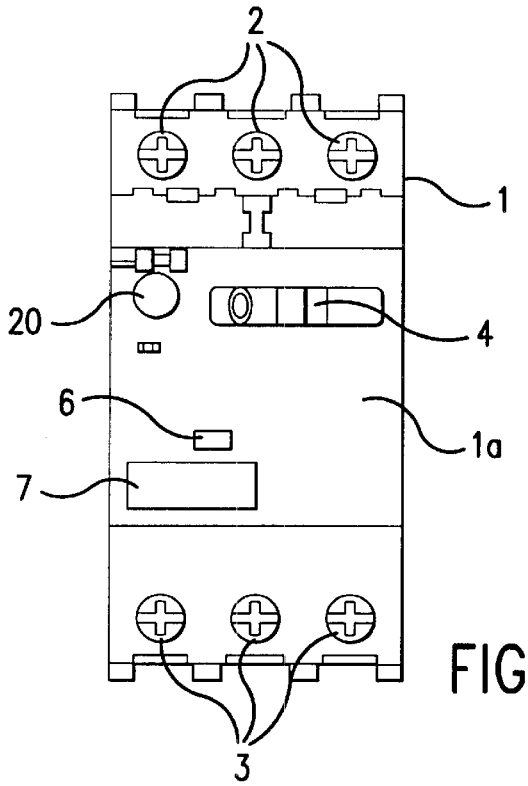
FIG. 4 is a plan view showing the circuit breaker shown in FIGS. 1(*a*) and 1(*b*) with the case cover placed thereon.

Further, the dummy dial 20 replaced instead of the adjustment dial 5 (see FIG. 5) has the same outward shape as the adjustment dial of the standard circuit breaker, but has a flat top surface to eliminate the adjustment groove 5*a* of the standard circuit breaker. Then, as shown in FIG. 4, the case cover 1*a* comprises the cover of the standard circuit breaker, which is similar to the cover shown in FIG. 5, so that the dummy dial 20 aligns with the dial hole. The cover 1*a*, shown in FIG. 4, has no current value printed around the periphery of its dial hole.

Figure 6A:
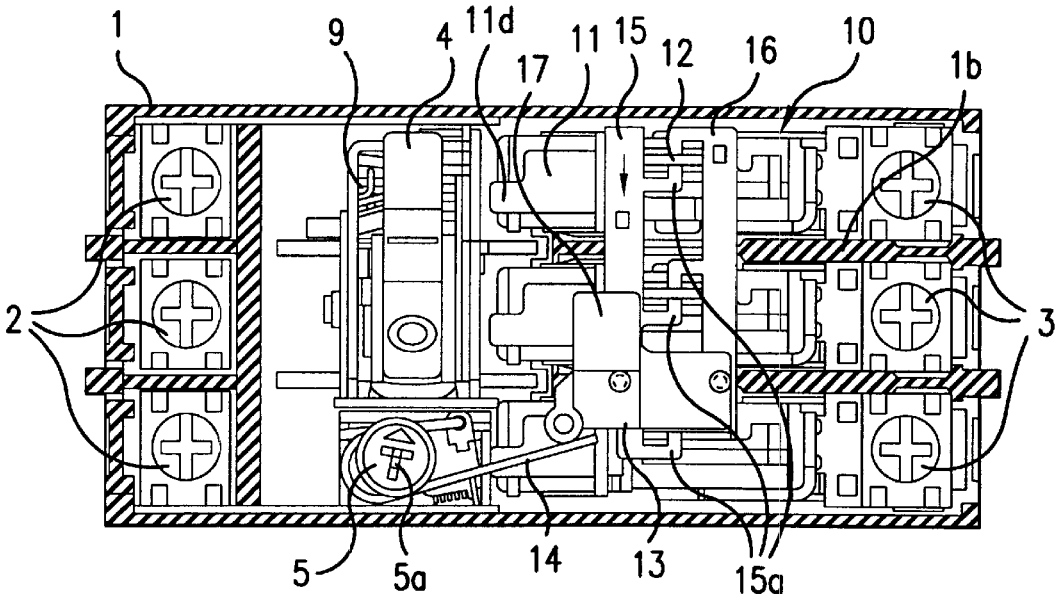
FIG.6a PRIOR ART
FIGS. 6(*a*) and 6(*b*) are views showing an internal structure of the standard circuit breaker, wherein FIG. 6(*a*) is a plan view showing the circuit breaker with its case cover removed, and FIG. 6(*b*) is a side sectional view of FIG. 6(*a*).
Figure 6B:
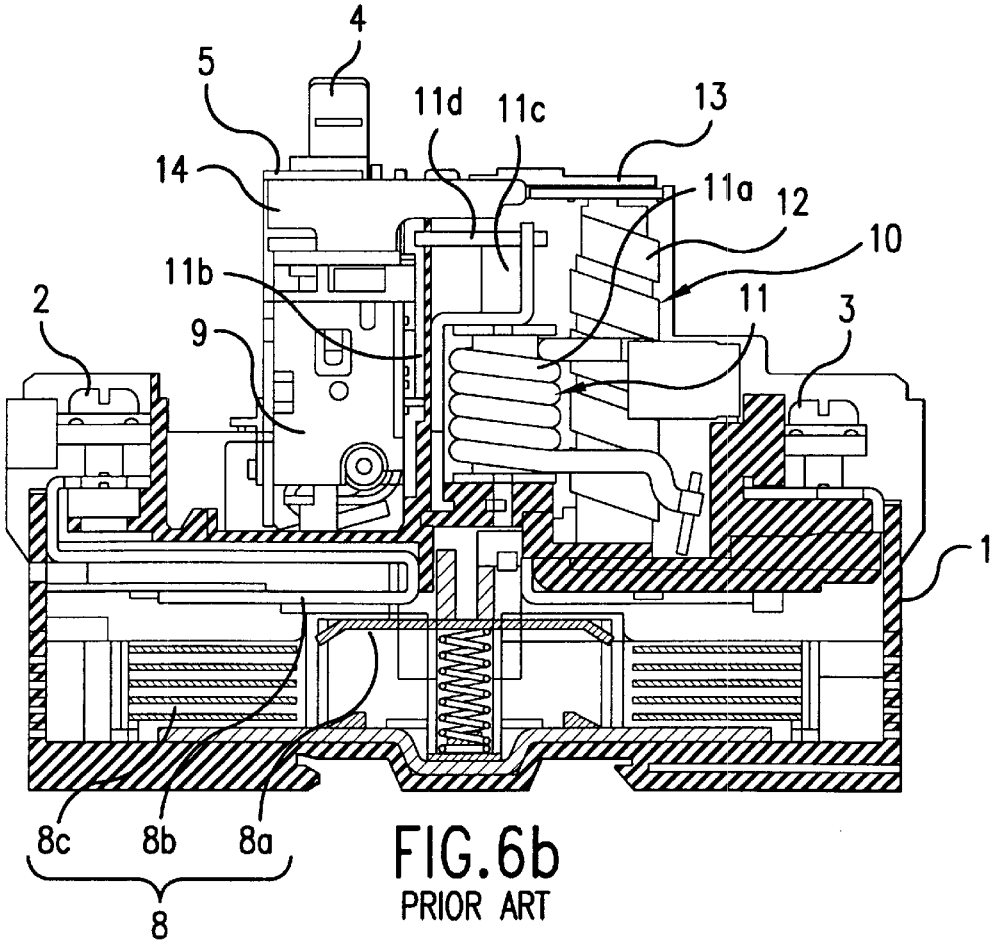
FIG.6b PRIOR ART

As described above, as a variation of the standard circuit breaker shown in FIGS. 6(*a*) and 6(*b*), the heater-mounted main bimetal and the differential shifter mechanism are removed from the thermal overload/open-phase tripping device installed in the circuit breaker. Consequently, this circuit breaker can be used as an instantaneous-tripping circuit breaker that provides no overload/open-phase tripping function. Accordingly, when this circuit breaker is applied to a distribution circuit using as a load an electric motor requiring an extended period for start-up, the circuit breaker is prevented from inadvertently performing a trip operation while the electric motor is being started up. Further, since the trip coil of the electromagnetic instantaneous tripping device is connected to the main circuit via a connection conductor with a low resistance, which is replaced instead of the bimetal heater, it is possible to withstand the required amount of overload current for the instantaneous breaking method.

Furthermore, the test-tripping part 19 shown in FIG. 3 is installed in place of the differential shifter mechanism of the overload/open-phase tripping device of the standard circuit breaker, to enable a trip test to be conducted while the circuit breaker is not electrically conductive, as described later. That is, the trip-test procedure comprises insertion of a screwdriver or the like into the test trip slot 6 opened in the case cover 1*a* shown in FIG. 4, and pushing of a projecting step portion on the output lever 17 located inside the slot in the direction indicated by an arrow in FIG. 3. The output lever 17 is then pivoted counterclockwise around a shaft support point shared with the guide plate 19*a*, thereby releasing the latch receiver of the opening and closing mechanism section 9 via the temperature compensating bimetal 14 shown in FIGS. 1(*a*) and 1(*b*). In response, the circuit breaker performs a trip operation.

As described above, according to the present invention, a standard circuit breaker equipped with the thermal overload/open-phase tripping device and an electromagnetic instantaneous tripping device can be changed, as a variation thereof, to a reliable instantaneous-tripping circuit breaker in which a trip-test function remains enabled while an overload/open-phase tripping function is disabled, and which can withstand a sufficient amount of overload current for the instantaneous breaking method, simply by removing parts of the thermal overload/open-phase tripping device installed in the standard circuit breaker and replacing them with other parts. Therefore, on the basis of the standard circuit breaker, an instantaneous-tripping circuit breaker can be provided without any substantial increase in cost, which is preferably applicable to a distribution facility or the like that uses as a load an electric motor requiring an extended period for start-up.

While the invention has been explained with reference to the specific embodiment of the invention, the explanation is illustrative and the invention is limited only by the appended claims.

What is claimed is:

1. An instantaneous-tripping circuit breaker comprising: a breaking section of a main circuit; an opening-and-closing mechanism section for actuating the breaking section and having a latch receiver for operating the opening-and-closing mechanism for tripping; a thermal overload/open-phase tripping device attached to the breaking section and including a differential shifter mechanism, a temperature-compensating bimetal for linking an output end of the differential shifter mechanism with the latch receiver of the opening-and-closing mechanism section and operating as a tripping lever, and an adjustment dial for adjusting a rated current; an electromagnetic instantaneous-tripping device attached to the breaking section and having a trip coil; and a connection conductor directly connected between the main circuit and the trip coil and having a resistance lower than that of a heater-mounted bimetal so that the circuit breaker can provide a required amount of an overload current.

2. An instantaneous-tripping circuit breaker comprising: a breaking section of a main circuit; an opening-and-closing mechanism section for actuating the breaking section and having a latch receiver for operating the opening-and-closing mechanism for tripping; a thermal overload/open-phase tripping device attached to the breaking section and including a temperature-compensating bimetal to face the latch receiver of the opening-and-closing mechanism section and operating as a tripping lever; a test-tripping part; an output lever supported on the test-tripping part and located opposite to the temperature-compensating bimetal so that the output lever is operated from outside to conduct a trip test on the breaker; an electromagnetic instantaneous-tripping device attached to the breaking section and having a trip coil; and a connection conductor directly connected between the main circuit and the trip coil and having a resistance lower than that of a heater-mounted bimetal so that the circuit breaker can provide a required amount of an overload current.

3. An instantaneous-tripping circuit breaker according to claim 2, further comprising a dummy dial having no adjustment function to face a dial hole in a breaker case.

* * * * *